United States Patent [19]

Ogasawara et al.

[11] Patent Number: 4,648,826

[45] Date of Patent: Mar. 10, 1987

[54] MELT-SPINNING APPARATUS

[75] Inventors: Masafumi Ogasawara, Otsu; Nobu Yamaguchi, Shiga; Yoshikazu Moriki, Otsu, all of Japan

[73] Assignee: Toray Industries, Inc., Japan

[21] Appl. No.: 710,095

[22] Filed: Mar. 11, 1985

[51] Int. Cl.[4] ..... D01D 4/08

[52] U.S. Cl. ..... 425/192 S; 264/176.1; 425/378 S; 425/463

[58] Field of Search ..... 425/182, 190, 192 R, 425/192 S, 378 S, 378 R, 379 S, 379 R, 382.2, 461, 462–464, 131.5; 264/176 F

[56] References Cited

U.S. PATENT DOCUMENTS

| | | | |
|---|---|---|---|
| 3,050,774 | 8/1962 | Tait | 425/463 |
| 3,197,815 | 8/1965 | Van Riper | 425/190 |
| 3,479,692 | 11/1969 | Van Den Biggelaar | 425/190 |
| 3,488,806 | 1/1970 | De Cecco et al. | 425/463 |
| 3,509,598 | 5/1970 | Van Den Biggelaar | 425/382.2 |
| 3,559,237 | 2/1971 | Van Den Biggelaar | 425/131.5 |
| 3,655,314 | 4/1972 | Lenk et al. | 425/131.5 |
| 3,864,068 | 2/1975 | Flakne | 425/378 S |
| 3,891,379 | 6/1975 | Lenk | 425/382.2 |
| 3,948,592 | 4/1976 | Schad et al. | 425/382.2 |
| 4,035,127 | 7/1977 | Ogasawara et al. | 425/192 S |
| 4,035,441 | 7/1977 | Endo et al. | 264/171 |
| 4,225,299 | 9/1980 | Roberts | 425/382.2 |

FOREIGN PATENT DOCUMENTS

| | | | |
|---|---|---|---|
| 42-9490 | 5/1967 | Japan . | |
| 43-8974 | 4/1968 | Japan | 425/192 S |
| 44-22526 | 9/1969 | Japan . | |
| 47-17727 | 5/1972 | Japan . | |
| 51-27772 | 8/1976 | Japan . | |
| 52-17127 | 5/1977 | Japan . | |
| 53-29732 | 8/1978 | Japan . | |
| 58-37405 | 8/1983 | Japan . | |
| 59-53713 | 3/1984 | Japan | 425/190 |

*Primary Examiner*—Jay H. Woo
*Assistant Examiner*—J. Fortenberry
*Attorney, Agent, or Firm*—Austin R. Miller

[57] ABSTRACT

A melt-spinning apparatus usable for producing various synthetic fibers in various manners, including a polymer melter; a heat-insulating housing having a detachable ceiling cover and a bottom having an opening; a detachable beam block having a cavity formed between a pair of longitudinal side walls, one of which has a polymer melt outlet; a melt-spinning pack arranged below the beam block and having a head projection inserted into the cavity, the head projection having a polymer melt inlet; a polymer melt passage system extending from the polymer melter to the polymer melt outlet; a fixing means for fixing the melt-spinning pack detachably to the beam block including a pushing member for pushing the head projection of the melt-spinning pack toward the longitudinal side wall having the polymer melt outlet to cause the polymer melt inlets to be fluidtightly connected to the polymer melt outlets, and optionally, means for protecting the polymer melt inlet from damage which the melt-spinning pack is inserted into the cavity of the beam block.

11 Claims, 48 Drawing Figures

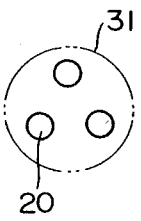
Fig.9A
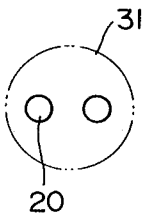
Fig.9B
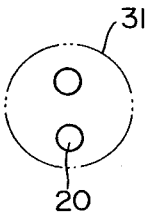
Fig.9C
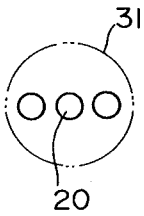
Fig.9D
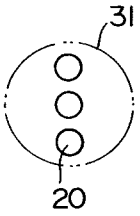
Fig.9E
Fig.9F
Fig.9G
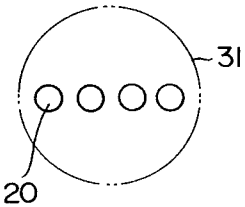
Fig.9H
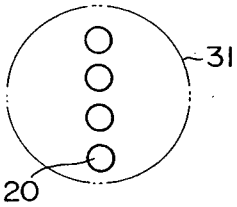
Fig.9I

MELT-SPINNING APPARATUS

BACKGROUND OF THE INVENTION

1. Field of the Invention

The present invention relates to a melt-spinning apparatus for producing syhthetic fibers. More particularly, the present invention relates to a melt-spinning apparatus which is usable for producing synthetic fibers from a single polymer component or a plurality of polymer components. Still more particularly, the present invention relates to a melt-spinning apparatus for producing synthetic fibers, in which apparatus at least one melt spinning pack having at least one polymer melt inlet can be connected to a beam block for holding the melt-spinning pack while protecting the polymer melt inlet from damage, and a polymer melt passage from at least one polymer melter to the melt-spinning pack can be easily cleaned.

2. Description of the Related Art

It is known that a conventional melt-spinning apparatus for producing synthetic fibers includes a melter in which polymer chips are melted and from which the polymer melt is extruded, a metering pumps into which the extruded polymer melt is distributed through a conduit, a pump block to which the metering pump and the conduit are connected, a conduit for introducing the metered polymer melt into a melt-spinning pack, a heating box for heating the conduits and pack at a desired temperature, and a housing for containing therein the above-mentioned pump block, heating box, and melt-spinning pack. The above-mentioned elements contained in the housing are directly or indirectly heated to a desired temperature by heating liquid or heating vapor contained in the heating box.

Recently, many different types of synthetic fibers are demanded and produced in small amounts. Also, special types of fibers, having special properties, for example, special blended polymer fibers or composite fibers, are demanded. In order to respond to the various demands, apparatus for producing the synthetic fibers should be able to be easily used for various purposes. When the type of the polymer to be fed into the melt-spinning apparatus is changed, it is sometimes necessary to completely clean out the passages of the polymer melt before a different type of polymer is fed thereinto.

In a conventional melt-spinning apparatus, sometimes the passages of the polymer melt from the polymer melter to the melt-spinning pack are fixed completely or partly non-detachably to the heating box. Otherwise, the melt-spinning apparatus has a complicated structure and it is difficult to detach and assemble the apparatus on site. Accordingly, the polymer melt passages are usually cleaned out by diluting and replacing the remaining polymer melt in the passages by another polymer melt. This cleaning process entails a large amount of the polymer and long period of time, decreasing the operational efficiency of the apparatus and increasing the cost of the resultant products.

In the structure of a conventional melt-spinning apparatus, the melt-spinning pack is inserted into a heating-box type housing from the top or bottom thereof. This type of melt-spinning apparatus is disclosed in Japanese Examined Patent Publication (Kokoku) Nos. 51-27772, 47-17727, 52-17127, and 43-8974.

Recently, a new type of melt-spinning pack which is capable of producing a plurality of filament yarns has been developed. This type of melt-spinning pack is a large size or is very long. This large or long melt-spinning pack cannot be set into the heating-box type housing by human operators alone, but requires a special machine.

In a special type of melt-spinning apparatus for producing synthetic composite fibers consisting of a plurality of different polymers, the melt-spinning pack has a large height. This type of melt-spinning pack also can be set into the housing only by machine power.

Machine power is used for setting the melt-spinning pack for other reasons as well, for example, a desire to reduce the heavy manual labor of the workers.

In a usual setting operation for the melt-spinning pack, the pack is preliminarily heated to a slightly higher temperature than the desired spinning temperature within a heater, is removed from the heater just before the insertion operation, and is then set into the heating-box type housing. In order to start the melt-spinning operation as soon as possible after the setting operation is completed, it is necessary to make the decrease of the temperature of the melt-spinning pack during the setting operation as small as possible. For this purpose, the setting operation should be completed as fast as possible by using machine power.

As shown in Japanese Examined Patent Publication (Kokoku) No. 43-8974, a melt-spinning pack having a polymer melt inlet located on a side surface of the pack is combined with a polymer melt outlet formed on an inside side surface of a pack receiving-chamber in such a manner that the polymer melt inlet of the melt-spinning pack is fluidtightly connected to the polymer melt outlet of the pack receiving-chamber. The fluidtight connection is usually attained by placing a gasket between the polymer melt inlet and outlet. In the setting operation, the gasket is usually placed around the polymer melt inlet of the melt-spinning pack, and the melt-spinning pack is inserted upward into the pack receiving-chamber. It is important that the setting operation be carried out as fast as possible while protecting the the polymer melt inlet from undesirable contact with the inside side surface of the pack receiving-chamber even when the setting operation is carried out by machine power. Also, it is important that the polymer melt inlet of the melt-spinning pack be precisely positioned on and fluidtightly connected to the polymer melt-outlet of the pack receiving-chamber, without undesirable removal, slippage, or damage of the polymer melt inlet, by pressing or pushing the inserted melt-spinning pack toward the inside side surface of the pack receiving-chamber. Furthermore, it is important that the melt-spinning pack can be easily detached from the pack receiving-chamber. Still further, it is important that even if the setting operation is carried out by nonskilled manpower, the operation can be easily carried out without difficulty.

SUMMARY OF THE INVENTION

An object of the present invention is to provide a melt-spinning apparatus in which a melt-spinning pack can be set from below and detached from below.

Another object of the present invention is to provide a melt-spinning apparatus in which passage of a polymer melt to be melt spun from a polymer melter to a melt-spinning pack can be easily disassembled and cleaned.

Still another object of the present invention is to provide a melt-spinning apparatus in which a beam block for holding a melt-spinning pack is detachably set in a housing having a heating box.

A further object of the present invention is to provide a melt-spinning apparatus adequate for producing not only a simple component filament yarn but also a multiple component filament yarn.

The above-mentioned objects can be attained by the melt-spinning apparatus of the present invention, which includes (A) a polymer melter; (B) a housing including a heating box having a ceiling cover which is detachable from the housing and a bottom having an opening; (C) a beam block, for holding a melt-spinning pack detachably set to the housing and comprising a head portion thereof and a pair of longitudinal side walls extending from the head portion of the beam block to form a cavity, one of the longitudinal side walls having a polymer melt outlet opening at the inside surface thereof; (D) a polymer melt passage system extending from the polymer melter to the polymer melt outlet through the housing and the beam block; (E) a melt-spinning pack arranged below the beam block within the housing and having a head projection inserted upward into the cavity of the beam block and detachably set to the beam block, the head projection having a pair of longitudinal side surfaces opposite to each other, one of which surfaces is provided with a polymer melt inlet facing the polymer melt outlet of the beam block; and (F) fixing means for detachably fixing the melt-spinning pack to the beam block, comprising a pushing member inserted from the outside of the housing toward the cavity of the beam block, which pushing member pushes the head projection against the longitudinal side wall having the polymer melt outlet of the beam block to connect the polymer melt inlet of the head projection to the polymer melt outlet of the beam block.

In the apparatus of the present invention, the other longitudinal side surface of the head projection is preferably provided with a concavity. When the pushing member is inserted into the concavity, the melt-spinning pack can be firmly fixed to the beam block.

Also, the pushing member can be engaged with the other longitudinal side wall of the beam block preferably in a screw-tapped hole engagement so as to absorb the reaction force against the pushing force applied to the pushing member by the other longitudinal side wall of the beam block.

BRIEF DESCRIPTION OF THE DRAWINGS

FIGS. 9A to 9I respectively show an arrangement of one or more polymer melt outlets formed in the beam block for holding the melt-spinning pack;

DESCRIPTION OF THE PREFERRED EMBODIMENTS

Figure 1:
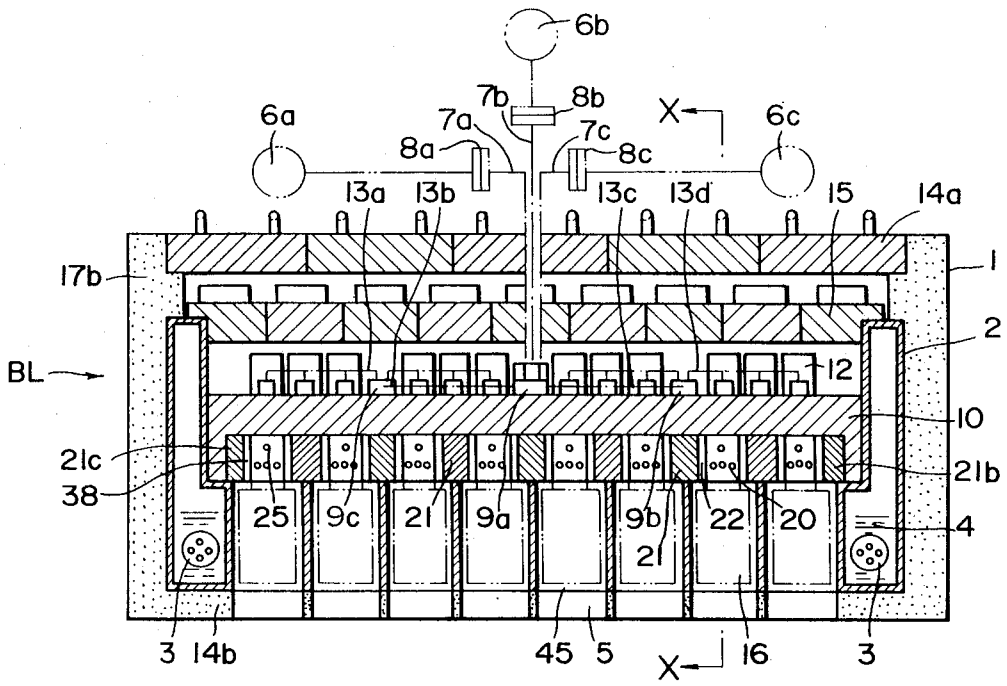
FIG. 1 is a longitudinal cross-sectional view of an embodiment of the melt-spinning apparatus of the present invention.

In general, the melt-spinning apparatus of the present invention includes at least one polymer melter, a box-shaped housing having openings at the top and bottom respectively, a melt-spinning pack-holding beam block contained in the housing, a polymer melt-passage system from the polymer melter to the beam block through the housing, and at least one melt-spinning pack placed below the beam block in the housing.

Referring to FIGS. 1, 2, 3, and 4, a melt-spinning block BL has a heat-insulating housing 1 formed by a pair of longitudinal side walls 17*a*, a pair of lateral side walls 17*b*, at least one ceiling cover 14*a* and a bottom cover 14*b* having an opening 5 extending along the longitudinal side walls 17*a*, each of the side walls 17*a*, the ceiling cover 14*a*, and the bottom cover 14*b* being made of a heat-insulating material. In the housing 1, at least one set of heating boxes 2 is arranged along the inside surfaces of the side walls 17*a*, 17*b* or at least the longitudinal side walls 17*a*. The surfaces of the heating boxes 2 not contacting the heat-insulating material are formed by a heat-conductive material. The heating box 2 contains a heating medium 4 and a heater 3, for heating the heating medium 4. An intermediate ceiling block 15 is mounted on the top ends of the heating boxes 2 and is in contact with the heat-conductive surfaces of the heating boxes 2.

A beam block 10 for holding at least one melt-spinning pack 16 is arranged below the heat-conductive ceiling block 15. The housing 1 has a space 45 formed below the beam block 10. The space 45 is adequate for containing therein at least one melt-spinning pack 16. In FIG. 1, eight melt-spinning packs 16 are contained in the eight spaces 45 respectively.

The melt-spinning pack 16 may have a structure as disclosed, for example, by Japanese Examined Patent Publication (Kokoku) Nos. 53-29732, 58-37405, and 44-22526 and U.S. Pat. No. 4,035,441.

The beam block 10 is detachably set to the housing 1 and has at least one cavity 38, (for example, eight cavities as shown in FIG. 1) surrounded by a pair of lateral side walls (guide blocks) 21, 21*b*, or 21*c* and a pair of longitudinal side walls 47 and 48 extending downward from the beam block 10. The longitudinal side wall 47 has one or more polymer melt outlets 20 opening at the inside surface thereof.

One or more polymer melters 6*a*, 6*b*, and 6*c* are located outside of the housing 1. The polymer melters 6*a*, 6*b*, and 6*c* are connected to metering pump blocks 12 containing metering pumps 11 through flanges 8*a*, 8*b*, and 8*c* and conduits 7*a*, 7*b*, and 7*c* and 13*a*, 13*b*, 13*c*, and 13*d* and distribution blocks 9*a*, 9*b*, and 9*c*. The metering pump blocks 12 are detachably set above the beam block 10.

Figure 13:
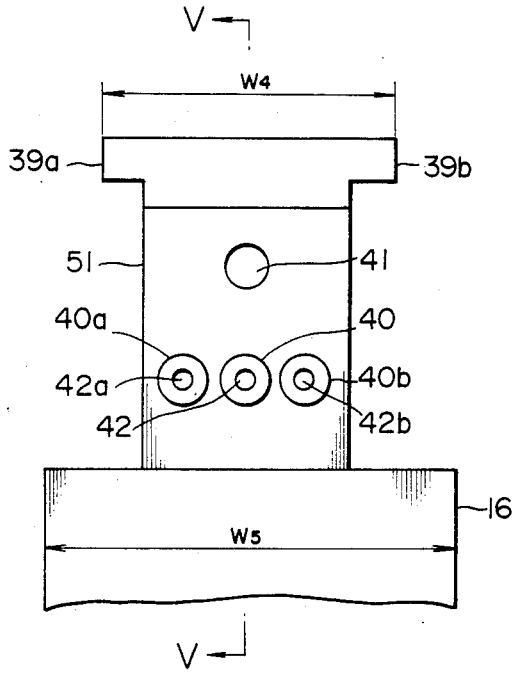
FIG. 13 is a back view of an embodiment of the head projection of the melt-spinning pack usable for the present invention.
Figure 14:
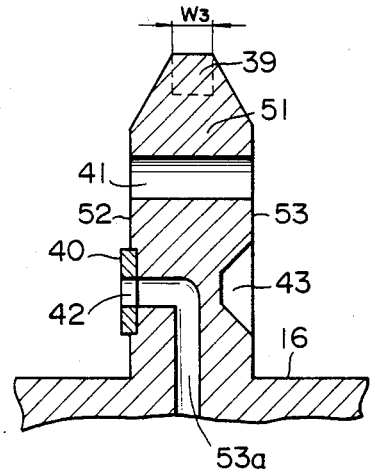
FIG. 14 is a cross-sectional view of the head projection as indicated at V—V in FIG. 13.

The melt-spinning pack 16 has a head projection 51, as shown in FIGS. 13 and 14, extending upward.

When the melt-spinning pack 16 is inserted into the space 45 so that the head projection 51 is inserted into the cavity 38, the melt-spinning pack 16 is supported by the beam block 10 by inserting a hanging pin 23 from the outside of the housing 1, through holes 25 formed in one of the longitudinal side walls 17a of the housing 1, the heating box 2, one of the longitudinal side walls 48 of the beam block 10, and the head projection 51, into the other longitudinal side walls 47. The head projection 51 is pushed toward the longitudinal side walls 47 by means of a pushing bolt 24 inserted from the outside of the housing 1 through holes 44.

The head projection 51 is provided with projections 39*a* and 39*b*, as shown in FIGS. 5, 13, 14, 15, and 16, extending from the top portion of the lateral side surfaces of the head projection 51 in opposite directions in parallel to the longitudinal side surface of the head projection 51.

The lateral side walls 10*a* of the cavity 38 of the beam block 10 are formed by guide blocks 21 fixed to the beam block 10. The guide block 21 has guide grooves 22 which are effective for guiding the projections 39*a* and 39*b* so that a gasket 40, 40*a*, 40*b*, as shown in FIGS. 13 to 16, is protected from undesirable contact with the inside surface of the cavity 38 when the head projection 51 is inserted into the cavity 38.

Figure 2:
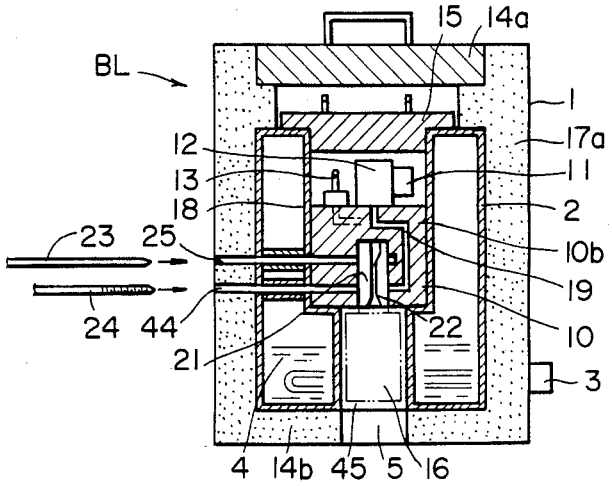
FIG. 2 is a lateral cross-sectional view of the melt-spinning apparatus as shown at X—X in FIG. 1.

The heating medium 4 contained in the heating box 2 is heated by the heater 3 inserted from the outside of the housing 1 into the heating box 2, and the resultant vapor of the heating medium is used to maintain the temperatures of the melt-spinning pack 16, the beam block 10, and the metering pump block 12 contained in the housing 1 at desired levels. The heat of the heating medium vapor is directly or indirectly transmitted to the above-mentioned elements through the heat-conductive surfaces of the heating boxes and the heat conductive intermediate ceiling block 15. It is preferable that at least the lower surface of the beam block 10 be in direct contact with the heat-conductive surfaces of the heating boxes 2, as shown in FIGS. 1 and 2.

The heat-insulating material to be used for the housing 1 may be selected from usual heat-insulating material and is effective for maintaining the temperature of the inside of the housing 1 at a desired level.

The bottom 14*b* of the housing 1 has an opening 5 through which the melt-spinning packs 16 are inserted and removed and the resultant filament yarn is taken up. The opening 5 is connected to the space 45 formed in the lower half portion of the housing 1, in which space 45 the melt-spinning packs 16 are contained. In the upper half portion of the housing 1, the beam block 10 for holding the melt-spinning packs 16, the metering pump blocks 12, the metering pumps 11, the polymer melt distribution conduits 7*a*, 7*b*, and 7*c*, and 13*a*, 13*b*, 13*c*, and 13*d*, and the polymer melt distribution blocks 9*a*, 9*b*, and 9*c* are detachably set. The heat-insulating ceiling 14*a* and heat-conductive intermediate ceiling 15 are arranged at a distance from each other. The intermediate ceiling 15 is in direct contact with the heat-conductive surfaces of the heating boxes 2.

This direct contact is also effective for rapidly heating the beam block 10 and the other elements contained in the upper portion of the housing 1 to a desired temperature. The ceilings 14*a* and 15 are detachable from the housing 1 and may be composed of a plurality of constituents detachably connected to each other.

The positioning of the beam block 10 in the housing 1 can be precisely carried out by correctly positioning holes or grooves formed in suitable positions, for example, a longitudinal center, longitudinal ends of lower surface, or side surface, and by fixing the holes or grooves at the positions, for example, by means of pins. The above-mentioned positioning operation can be easily carried out in the apparatus of the present invention.

The passage system of the polymer melt from the polymer melters to the melt-spinning packs can be easily, divided into pieces. For example, the polymer melters 6*a*, 6*b*, and 6*c* can be easily separated from the polymer melt distribution conduits 7*a*, 7*b*, and 7*c* by dejoining the flanges 8*a*, 8*b*, and 8*c*. Also, the distribution conduits, distribution blocks, metering pump, and metering pump blocks are easily detached from each other. The beam block can be easily detached from the housing and the melt-spinning packs. Therefore, the divided polymer melt passages in the disjointed elements can be rapidly decreased.

The cleaned elements for forming the polymer melt passage system can be easily replaced in the apparatus within a short time.

For example, if it is desired to replace a two-polymer component passage by a three-polymer component passage as soon as possible after the two-polymer component spinning operation is completed, a cleaned three-polymer component passage is provided while the two-polymer component spinning operation is carried out. The replacing operation can be easily effected within a short time.

The apparatus of the present invention is not limited to the specific one as shown in FIGS. 1 and 2 having three polymer melters and eight melt-spinning packs. The apparatus of the present invention can contain one or more polymer melters and one or more melt-spinning packs.

Two or more spinning blocks BL as shown in FIGS. 1 and 2 may be connected in parallel and may be connected to one or more common polymer melters. In another example, the connected spinning blocks are covered by one housing and are connected to one or more common polymer melters. The connected spinning blocks are preferably separable from each other.

The beam block 10 for holding the melt-spinning packs 16 will now be explained in detail referring to FIGS. 3 to 9I.

Figure 3:
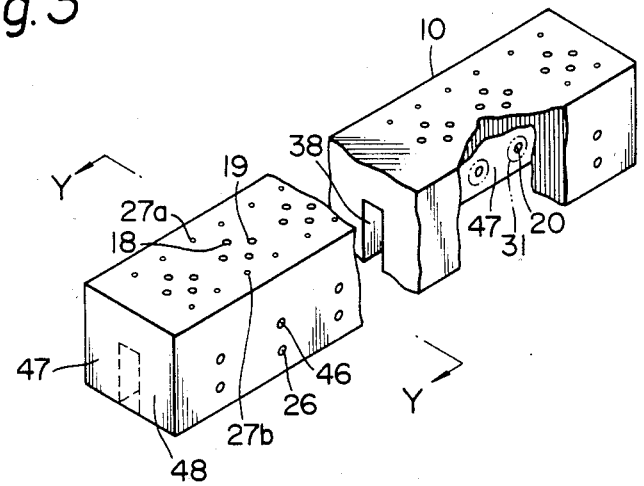
FIG. 3 is a partially broken perspective view of an embodiment of the beam block for holding a melt-spinning pack usable for the present invention.
Figure 4:
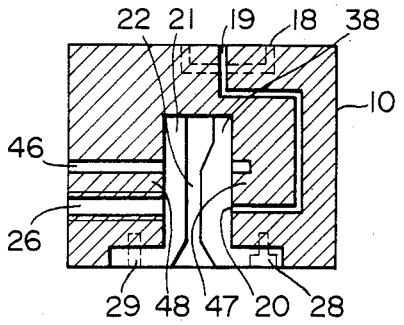
FIG. 4 is a lateral cross-sectional view of the beam block as indicated at Y—Y in FIG. 3.
Figure 5:
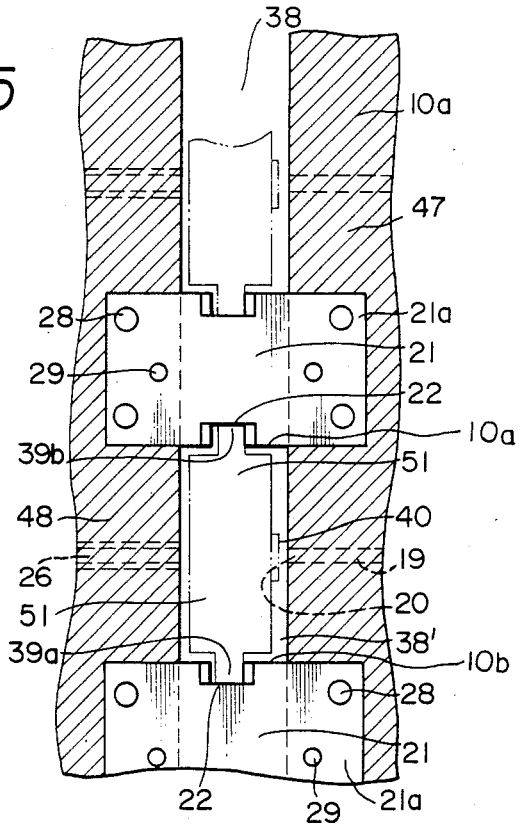
FIG. 5 is a partial bottom view of the beam block as indicated in FIG. 3.

Referring to FIGS. 3, 4, and 5, the beam block 10 has at least one cavity 38 longitudinally extending between a pair of longitudinal side walls 47, 48 and a polymer melt passage 19. An inside surface of the longitudinal side wall 47 has at least one polymer melt outlet 20, which is a downstream end of the polymer melt passage 19. The inside surface 47 may have one or more polymer melt outlets 20 arranged in a group 31 as shown in FIGS. 9A to 9I. Also, the inside surface of the side wall 47 may have one or more groups 31 consisting of one or more polymer melt outlets 20 arranged in line along the longitudinal direction of the longitudinal side wall 47. The polymer melt outlets are formed at positions corresponding to those of the polymer melt inlets of the melt-spinning pack to be connected thereto.

The pushing member can be engaged with the other longitudinal side wall 48 of the beam block in a screw-tapped hole engagement, to absorb the reaction force against the pushing force applied to the pushing member by the other longitudinal side wall 48 of the beam block 10, as shown in FIGS. 4, 11, 15, and 16.

The other longitudinal side wall 48 has one or more tapped holes 26 opening at the inside surface of the side wall 48. The open ends of the tapped holes 26 face the groups 31 of the polymer melt outlets 20 on the inside surface of the side wall 47. Also, the side wall 48 has one or more holes 46 opening at the inside surface thereof and located above the tapped holes 26.

The holes 46 in the side wall 48 further extend into the opposite side wall 47, as shown in FIG. 4.

The numbers of the tapped holes 26 and the holes 46 are the same as the number of the melt-spinning packs to be set to the beam block 10. The polymer melt distribution conduits, distribution blocks, metering pumps, and metering pump blocks as shown in FIG. 1 are detachably fixed to the beam block 10 by means of screws (not shown) screwed into tapped holes 27*a* and 27*b*. The passage 18 is formed to introduce a polymer melt supplied from the polymer melt distribution conduit into the metering pump. The passage 19 is used for introducing the polymer melt discharged from the metering pump to the corresponding melt-spinning pack through the polymer melt outlet 20.

Figure 6:
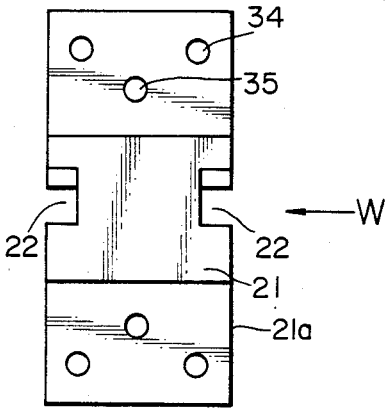
FIG. 6 is a plan view of an embodiment of the guide block to be inserted into and set at a cavity of a beam block usable for the present invention.
Figure 7:
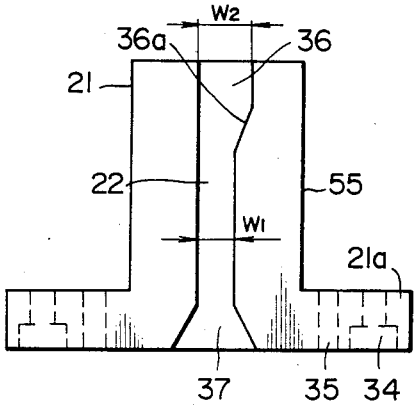
FIG. 7 is a side view of the guide block as shown in FIG. 6, seen from the right side thereof as shown by an arrow W in FIG. 6.

When the beam block has two or more cavities 38, they are separated from each other by guide blocks 21 inserted into the cavities 38. Referring to FIGS. 5, 6, and 7, the guide blocks 21 have a pair of bottom flanges 21*a* which are fixed to the bottom of the beam block 10 by means of bolts 28 and pin 29 inserted into holes 34 and holes 35, respectively.

The lateral side surfaces of the guide blocks 21 have vertical guide grooves 22. When the melt-spinning pack 16 is inserted in the space 45 through the opening 5, the projections 39*a* and 39*b* of the head projection 51, as shown in FIGS. 13 and 14, can be guided by the groove 22 so as to allow the head projection to move upward along the predetermined path thereof.

Referring to FIGS. 6 and 7, the upper end portion 36 of the groove 22 has a width $W_2$ larger than the width $W_1$ of the middle portion of the groove 22. That is, the width of the upper portion 36 of the groove 22 is widened toward the longitudinal side surface 55 of the guide block 21 facing the longitudinal side wall 47 having the polymer melt outlet 20. The widened portion 36 is connected to the middle portion of the groove 22 through a guide slope 36*a*. The widened portion 36 allows the head projection inserted into the cavity to move toward the longitudinal side wall 47 of the beam block 10 and the polymer melt inlet 40, 42 of the head projection 51 to be connected to the corresponding polymer melt outlet 20 of the beam block 10.

The lower portion 37 of the groove 22 may be widened toward both sides as shown in FIG. 7. This widened lower portion 37 is effective for smoothly introducing the projections 39*a* and 39*b* of the head projection 51 into the groove 22.

The guide block 21 as indicated in FIGS. 6 and 7 has two guide grooves 22 formed in the two opposite side surfaces thereof. This type of guide block 21 is used for partitioning two cavities from each other.

Figure 8A:
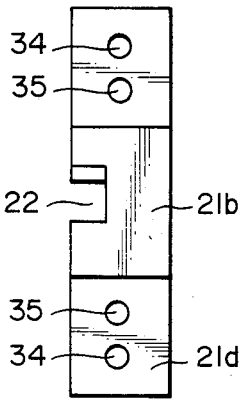
FIGS. 8A and 8B are a plan view of other embodiment of the guide block, respectively.
Figure 8B:
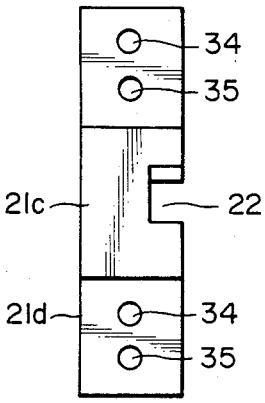

Other types of guide blocks 21*b* and 21*c* are indicated in FIGS. 8A and 8B. In each of the guide blocks 21*b* and 21*c*, a side surface to face a cavity has a guide groove 22. Each of the guide blocks 21*b* and 21*c* has a pair of bottom flanges 21*d*. The guide block 21*b* or 21*c* can be fixed to the bottom of the beam block 10 by means of bolts and pins (not shown) inserted into the tapped holes 35 and holes 34. Referring to FIG. 1, the guide block 21*b* shown in FIG. 8A is used to form a rightmost lateral side wall of the beam block 10 and the guide block 21*c* shown in FIG. 8B is used to provide a leftmost lateral side wall of the beam block 10.

In the melt-spinning apparatus of the present invention, one or more types of polymer melts can be supplied from one or more polymer melters to one or more polymer melt inlets, as shown in FIGS. 9A to 9I, in the beam block, through the distribution conduits and metering pumps arranged in an adequate manner for the type of the desired filament yarn.

Figure 10:
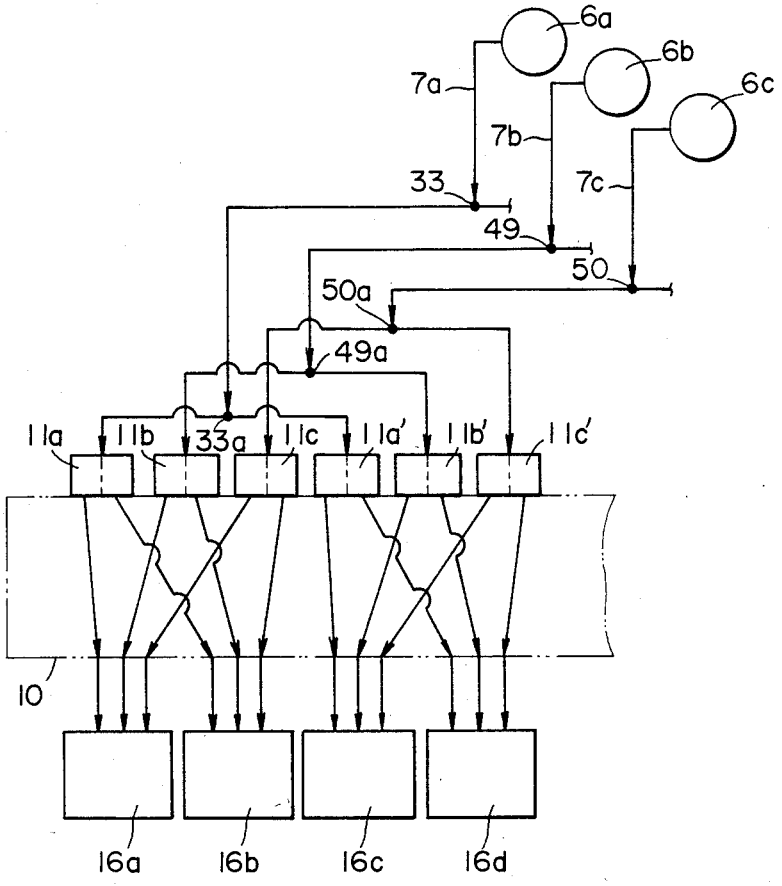
FIG. 10 shows an example of a passage of a polymer melt distributed from a plurality of polymer melters to a plurality of melt-spinning packs through a beam block.

FIG. 10 shows an example of a polymer melt distribution system usable for the apparatus of the present invention. In FIG. 10, the arrows indicate the directions of flow of the polymer melt.

The same or different types of polymers are melted in polymer melters 6*a*, 6*b*, and 6*c*. The resultant polymer melts are respectively extruded from the polymer melters 6*a*, 6*b*, and 6*c* through conduit 7*a*, 7*b*, and 7*c*. The flows of the polymer melts in the conduits 7*a*, 7*b*, and 7*c* are respectively divided into two flows in equivalent division at dividing points 33, 49, and 50 and then at dividing points 33*a*, 49*a*, and 50*a*. The divided flows of the polymer melts are introduced into metering pumps 11*a*, 11*b*, 11*c*, 11*a*', 11*b*', and 11*c*'. Then, the divided flows are extruded at predetermined flow rates from the metering pumps and are supplied to melt-spinning packs 16*a*, 16*b*, 16*c*, and 16*d* through passages and polymer melt outlets formed in a beam block 10.

In the above-mentioned polymer melt distribution system, it is easy to close some of the passages and/or the polymer melt outlets, if necessary.

Figure 11:
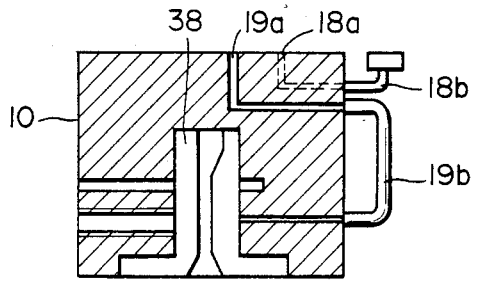
FIG. 11 is a lateral cross-sectional view of another embodiment of the beam block usable for the present invention having another polymer melt passage than that indicated in FIG. 4.

In the beam block 10 as shown in FIG. 4, the polymer melt passages 18 and 19 are formed completely within the beam block 10. However, this type of bent passage is difficult to produce. This difficulty can be eliminated by a beam block of the type indicated in FIG. 11. In FIG. 11, a bent passage 19*a* has a bent portion 19*b* thereof located outside of the beam block 10. Also, the bent passage 19*a* has a bent portion 18*b* thereof located outside of the beam block 10. The bent portions 18*b* and 19*b* of the passages can be formed by pipes.

Figure 12:
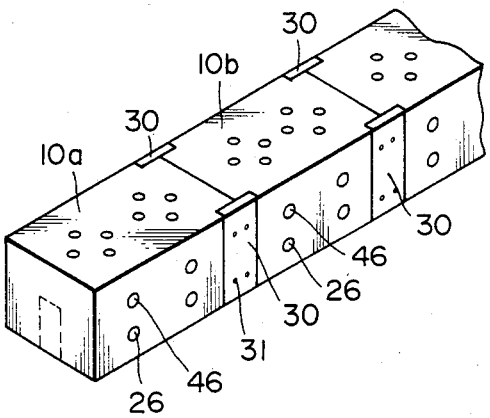
FIG. 12 is a partial perspective view of another embodiment of the beam block capable of being dejoined into a plurality of constituents.

The beam block 10 as indicated in FIG. 3 consists of one block. The beam block 10 as indicated in FIG. 12 may consist of a plurality of beam block constituents 10*a*, 10*b*, 10*c* fixed to each other with connectors 30 which are fixed to the constituents with means of screws or pins 31.

This type of beam block 10 can be easily divided into constituents. Each beam block constituent is provided with one or more polymer melt outlets (not shown in FIG. 12), one or more holes 26, and one or more tapped holes 46 to be used to set the melt-spinning packs to the beam block. Each polymer melt outlet formed in the beam block constituent is connected to a polymer melt distribution system, for example, as shown in FIG. 10. The polymer melt passages in the beam block constituents are easily cleaned by using a relatively small cleaning vessel.

The apparatus of the present invention is preferably provided with means for protecting the polymer melt inlet of the melt-spinning pack from damage while the melt-spinning pack is inserted into the cavity of the beam block. The polymer melt inlet-protecting means is provided in the head projection of the melt-spinning pack and at least one of the side walls surrounding the cavity of the beam block.

Referring to FIGS. 13, 14, 15 and 16, showing an embodiment of the polymer melt inlet-protecting means, a melt-spinning pack 16 has a head projection 51 extending upward and having a thickness smaller than that of the melt-spinning pack 16.

The head projection 51 has a pair of longitudinal surfaces 52 and 53 which respectively face the longitudinal walls 47 and 48 of the beam block 10 when the melt-spinning pack 16 is set to the beam block 10.

The longitudinal surface 52 is provided with one or more polymer melt inlets 42, 42*a*, 42*b* corresponding to the polymer melt outlets formed in the longitudinal wall 47 of the beam block 10. The polymer melt inlets 42, 42*a*, and 42*b* are connected fluidtightly to the polymer melt outlets through gaskets 40, 40*a*, and 40*b*. The polymer melt introduced through each polymer melt inlet flows to a spinneret (not shown) through a passage 53*a* and a filter (not shown).

The polymer melt inlets can be arranged in a manner corresponding to the arrangement of the polymer melt outlets as shown in FIGS. 9A to 9I. When a plurality of polymer melt inlets are provided in the head projection, each inlet may be connected to the corresponding outlet through an individual gasket. Otherwise, a group of a plurality of inlets may be connected to the corresponding group of outlets through a common gasket having the same number of holes as that of the inlets.

The head projection 51 is provided with a pair of projections 39*a* and 39*b* extending in two opposite directions from the top portion 39 of the head projection 1.

The distance $W_4$ between the ends of the projections 39*a* and 39*b* is smaller than the width $W_5$ of the melt-spinning pack 16. Therefore, the head projection 51 can be easily inserted into the corresponding cavity 38 of the beam block 10.

Figure 16:
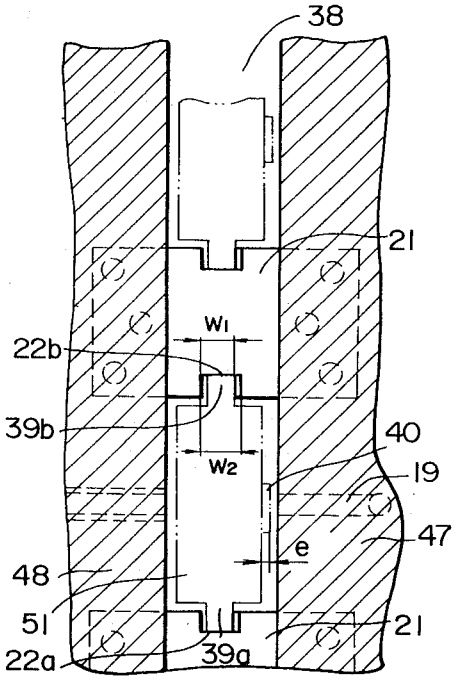
FIG. 16 is an explanatory cross-sectional view of the beam block as indicated at Q—Q in FIG. 15.
Figure 15:
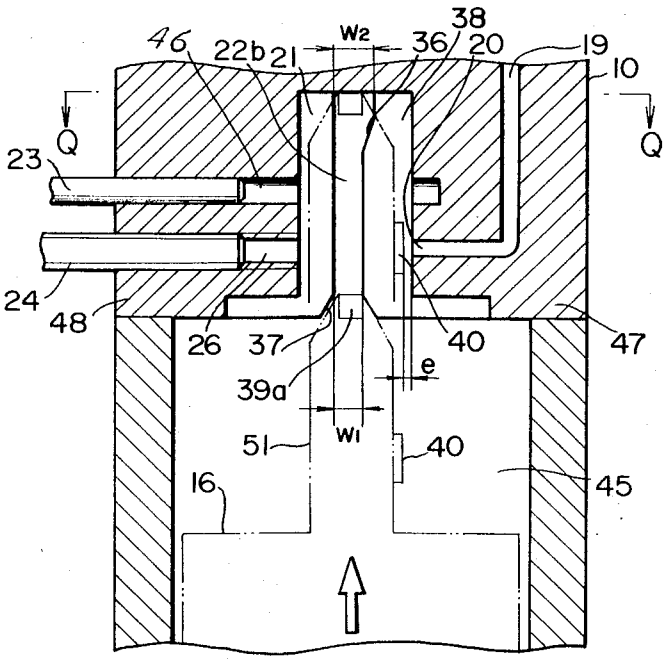
FIG. 15 is an explanatory cross-sectional view of a beam block for explaining an operation of setting a melt-spinning pack to the beam block.

The width $W_3$ of the projections 39*a* and 39*b* is designed such that the projections 39*a*, 39*b* can easily slide on the guide groove 22*a*, 22*b* as shown in FIG. 15 and 16. That is, the width $W_3$ is slightly smaller than the width $W_1$ of the guide groove 22*a*, 22*b*. The head projection 51 has a hole 41 adequate for inserting a hanging pin 23 therethrough, as shown in FIG. 15.

Also, the head projection 51 has a cone-shaped concavity 43, as shown in FIG. 14. Referring to FIG. 15 when a pushing bolt 24 is screwed through the longitudinal wall 48 of the beam block 10 into the concavity 43 of the head projection 51, the head projection 51 is pushed toward the longitudinal wall 47 of the beam block 10, and the polymer melt inlets 42 are connected to the corresponding polymer melt outlets 20 of the beam block 10. The concavity 43 is effective for precisely positioning the melt-spinning pack and for preventing undesirable damage of the surface 53 of the head projection 51 by the pushing bolt 24.

Referring to FIGS. 15 and 16, in the setting operation of the melt-spining pack 16, the melt-spinning pack 16 is inserted into the space 45 in the upward direction indicated by an arrow, by machine or man power. The head projection 51 is inserted into the cavity 38 in such a manner that a pair of projections 39*a* and 39*b* extending from the top portion of the head projection 51 are inserted into the middle portions of the corresponding guide grooves 22*a* and 22*b* through the widened lower end portion 37 thereof. By this operation, the head projection 51 is correctly positioned so that the gaskets 40 set up around the polymer melt inlets 42 are slightly spaced from the longitudinal side wall or first vertical wall 47 with a gap e. Therefore, in the setting operation of the melt-spinning pack 16, the gaskets 40 are protected from undesirable contact with the longitudinal side wall 47 of the beam block 10 and thus are prevented from damage, slipping, or detachment.

When the top projections 39*a*, 39*b* of the head projection 51 reach the widened top end portions 36 of the guide grooves 22*a* and 22*b*, the head projection 51 is pushed toward the longitudinal side wall 47 of the beam block 10 by means of a pushing bolt or shifting member 24 in the manner described above. Also, the head projection 51 is fixed to the longitudinal side walls 47 by means of a pushing bolt 24 alone or a hanging pin 23 and a pushing bolt 24. When the melt-spinning pack 16 is hung by the hanging pin 23, the melt-spinning pin can horizontally slip on the hanging pin toward the longitudinal side wall 47. In order to fluidtightly seal the connection of the polymer melt inlet or second conduit 42 with the polymer melt outlet or first conduit 20, it is necessary that the gasket 40 be compressed between a second vertical wall of the head projection 51 and the longitudinal side wall of the beam block 10. Therefore, it is important that the difference between the width $W_2$ of the widened top portion 36 and the width $W_1$ of the middle portion of the guide groove 22*a*, 22*b* be larger than the sum of the gap e and the difference between the original thickness of the gasket 40 and the thickness of the compressed gasket 40.

The top portion of the head projection 51 is upwardly tapered as shown in FIG. 14. Also, the lower end portions 37 of the guide grooves 22*a*, 22*b* are downwardly widened. The tapered top portion of the head projection 51 and the widened lower end portions of the guide grooves 22*a*, 22*b* are effective for smoothly introducing the head projection 51 into the cavity 38 and for correctly inserting the top projections of the head projection 51 into the guide grooves 22*a*, 22*b*.

In the case where the melt-spinning pack 16 is fixed to the beam block 10 by means of the hanging pin 23 and the pushing bolt 24, the melt-spinning pack 16 can be disjointed from the beam block 10 in such a manner that while the melt-spinning pack 16 is supported by a supporting stand (not shown), for example, as disclosed in Japanese Examined Patent Publication (Kokoku) No. 42-9490, the pushing bolt 24 is withdrawn from the concavity 43 of the head projection 51, the hanging pin 23 is removed so as to allow the melt-spinning pack 16 to full down by gravity while the top projection 39*a* and 39*b* of the head projection 51 slip down along the guide grooves 22*a* and 22*b* of the beam block 10, and finally, the melt-spinning pack 16 is withdrawn from the housing 1 by lowering the supporting stand.

Figure 17:
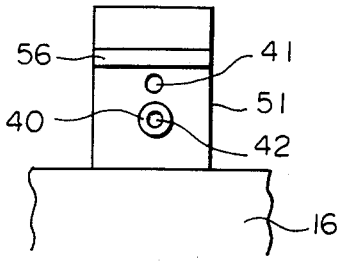
FIG. 17 is a back view of another embodiment of the head projection of the melt-spinning pack usable for the present invention.
Figure 18:
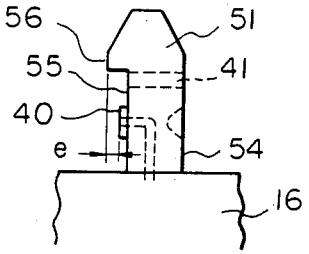
FIG. 18 is a lateral side view of the head projection as indicated in FIG. 17.
Figure 19:
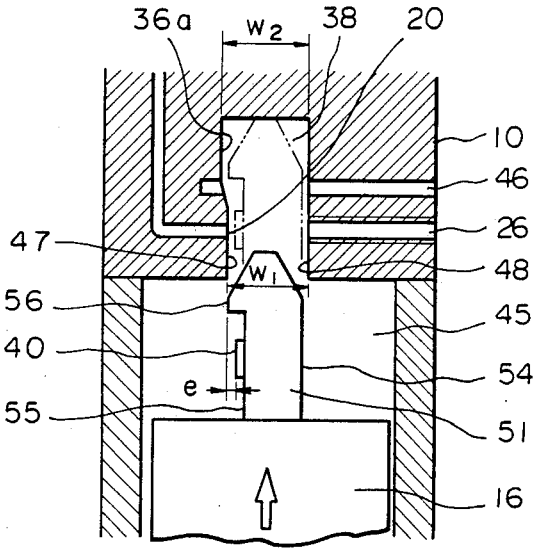
FIG. 19 is an explanatory cross-sectional view of a beam block for explaining an operation of setting a melt-spinning pack having the head projection as indicated in FIGS. 17 and 18 to the beam block.
Figure 20:
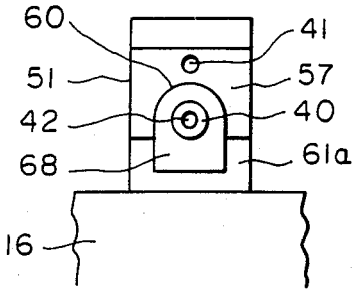
FIG. 20 is a back view of still another embodiment of the head projection of the melt-spinning pack usable for the present invention.
Figure 21:
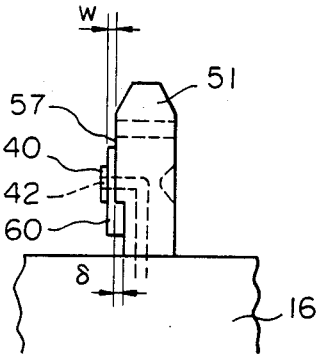
FIG. 21 is a lateral side view of the head projection as indicated in FIG. 20.
Figure 22:
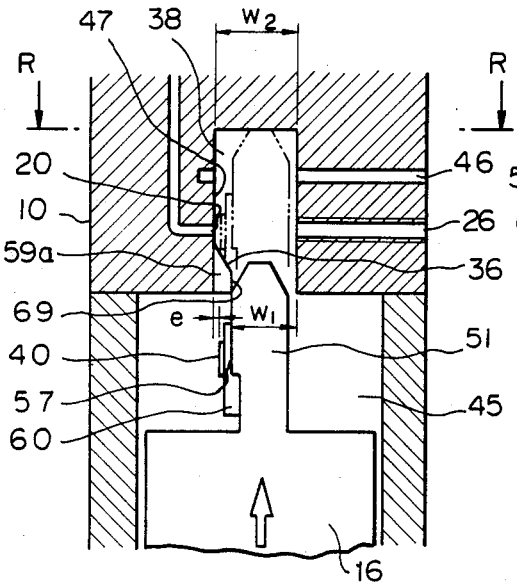
FIG. 22 is an explanatory cross-sectional view of a beam block for explaining an operation of setting a melt-spinning pack having the head projection as indicated in FIGS. 20 and 21.
Figure 23:
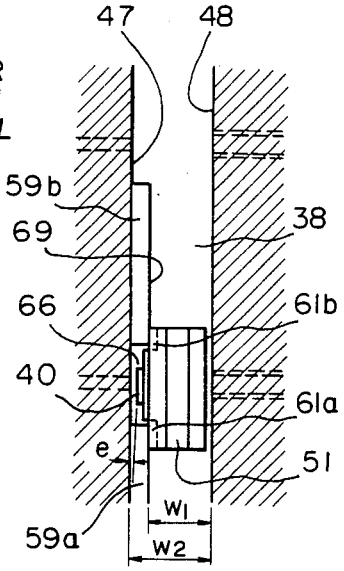
FIG. 23 is an explanatory cross-sectional view of the beam block as indicated at R—R in FIG. 22.
Figure 24:
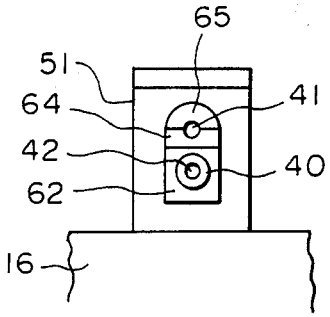
FIG. 24 is a back view of a further embodiment of the head projection of the melt-spinning pack usable for the present invention.
Figure 25:
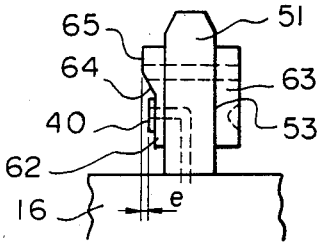
FIG. 25 is a lateral side view of the head projection as indicated in FIG. 24.
Figure 26:
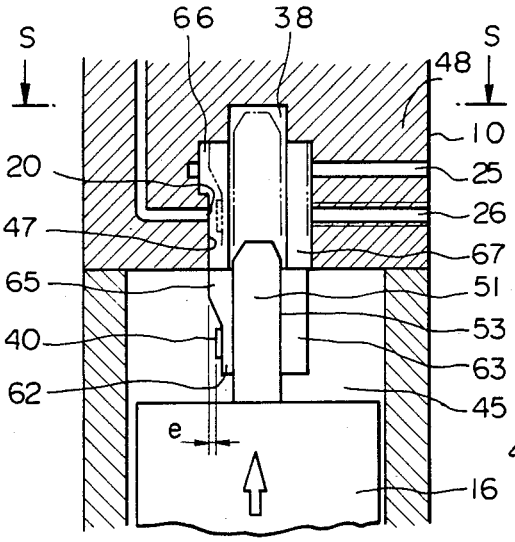
FIG. 26 is an explanatory cross-sectional view of a beam block for explaining an operation of setting a melt-spinning pack having the head projection as indicated in FIGS. 24 and 25.
Figure 27:
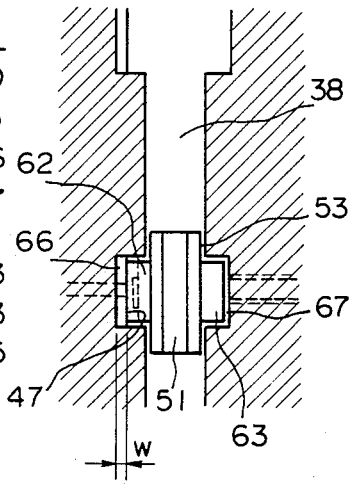
FIG. 27 is an explanatory cross-sectional view of the beam block as indicated at S—S in FIG. 26.

Referring to FIGS. 17 to 19 showing another embodiment of the polymer melt inlet-protecting means, the head projection has a flat longitudinal side surface 54 and a stepped longitudinal side surface 55 having a top projection 56 extending from the top portion of the longitudinal side surface 55 in a direction normal to the longitudinal side surface 55 in which the polymer melt inlet 42 is formed. A gasket 40 is attached to the polymer melt inlet 42.

The longitudinal side wall 47 having the polymer melt outlet 20 has a top concave 36*a* formed in the top portion thereof.

The top concave 36*a* is adequate to receive the top projection 56 when the head projection 51 is inserted into the cavity 38 of the beam block 10 and to allow the head projection 51 to move toward the longitudinal side wall 47 of the beam block 10. This movement causes the polymer melt inlet 42 to be connected to the polymer melt outlet 20.

Referring to FIGS. 20, 21, 22 and 23, showing still another embodiment of the polymer melt inlet-protecting means, the longitudinal side wall 47 of the beam block 10 having the polymer melt outlet 20 is provided with bottom projections 59*a* and 59*b* which extend from the bottom portion of the longitudinal side wall 47 and which are spaced from each other to form a guide groove 66 therebetween. In the guide groove 66, the polymer melt outlet 20 opens.

The longitudinal side surface 57 of the head projection 51 having the polymer melt inlet 42 has concavities 61*a* and 61*b* formed in the side bottom portions of the longitudinal side surface 57.

The bottom concaves 61*a* and 61*b* have a depth $\delta$ and face the bottom projections 59*a* and 59*b*, respectively. While the head projection 51 is inserted into the cavity 38 of the beam block 10, the side top portions of the longitudinal side surface 57 of the head projection 51 slide on the surfaces 69 of the bottom projections 59*a* and 59*b*. After the insertion of the head projection 51 is completed, the bottom concaves 61*a* and 61*b* allow the head projection 51 to move toward the longitudinal side wall 47 of the beam block 10 and the polymer melt inlet 42 to be connected to the polymer melt outlet 20.

The longitudinal side surface 57 of the head projection 51 is preferably provided with a projection 60 having a thickness w, in which projection 60 the polymer melt inlet 42 is formed.

Referring to FIGS. 24, 25, 26 and 27, showing a further embodiment of the polymer melt inlet-protecting means, the head projection 51 is provided with top projections 65 formed in the top portion of the longitudinal side surface having the polymer melt inlet 42.

The longitudinal side wall 47 having the polymer melt outlet 20 has a top concave 66 formed in the top portion thereof. The top concave 66 is in a location adequate to receive the top projection 65 when the head projection is inserted into the cavity 38 of the beam block 10. The other longitudinal side wall 48 of the beam block 10 has a vertical groove 67. The other longitudinal surface 53 of the head projection 51 is provided with a projection 63 capable of being engaged with the vertical groove 67 while the head projection 51 is inserted into the cavity 38 of the beam block 10. The vertical groove 67 and the projection 63 are effective for correctly guiding the insertion of the head projection 51.

The longitudinal side surface having the polymer melt inlet of the head projection 51 is prefarably provided with a projection 62 in which the polymer melt inlet opens. The projection 62 has a smaller height than that of the top projection 65 and is connected to the top projection 65 through a slope 64.

Figure 28:
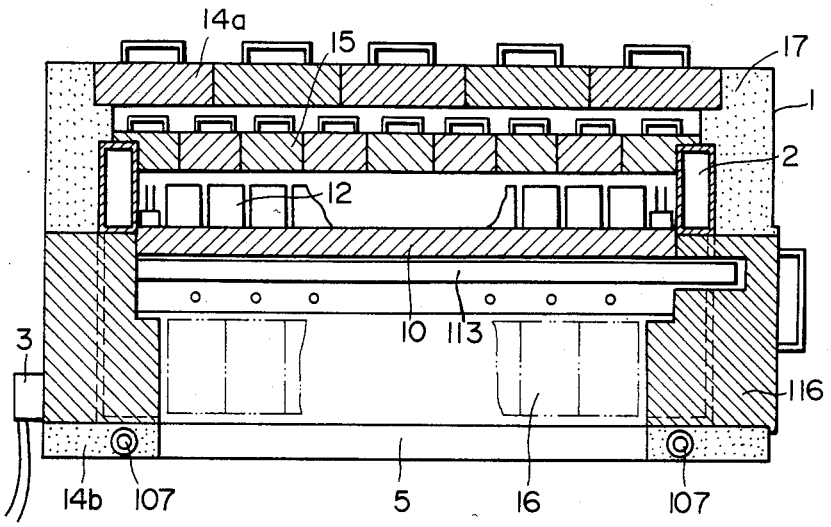
FIG. 28 is a longitudinal cross-sectional view of another embodiment of the melt-spinning apparatus of the present invention.
Figure 29:
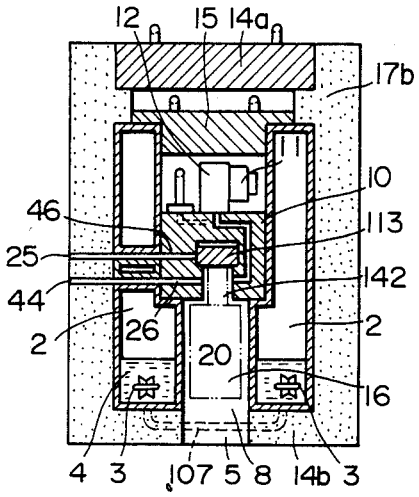
FIG. 29 is a lateral cross-sectional view of the apparatus as indicated in FIG. 28.
Figure 30:
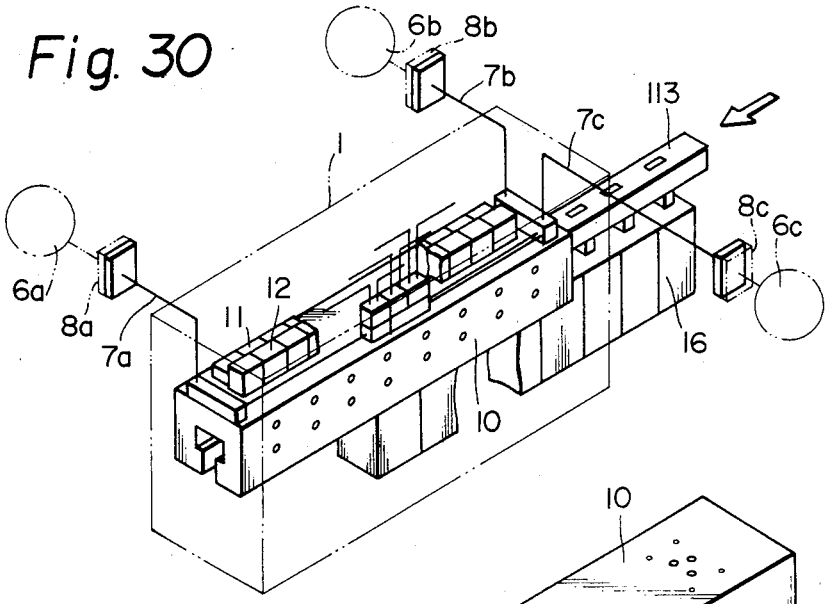
FIG. 30 is an explanatory perspective view of the apparatus as shown in FIG. 28, for showing an operation of a rail together with a plurality of melt-spinning packs into a housing.

In another embodiment of the apparatus of the present invention as shown in FIGS. 28 to 39, at least one melt-spinning pack 16 is set to a beam block 10 through a rail 113. A portion 116 of the lateral side wall is detachable from the housing 1. When the side wall 116 is detached from the housing 1, the rail 113 can be withdrawn together with the melt-spinning packs 16 from the beam block 10. In FIGS. 28, 29 and 30, the heating boxes 2 are connected to each other through a conduit 107. This connection is effective for evenly heating the inside of the housing 1.

The rail 113 can hold either a plurality of melt-spinning packs 16 or a single melt-spinning pack 16 having a large longitudinal length. Also, the insertion and withdrawal of the rail 113 can be effected by a man or machine power.

Also, the use of the rail 113 is advantageous in that a plurality of melt-spinning packs 16 can be correctly positioned and can be individually set or removed at the outside of the apparatus.

Figure 31:
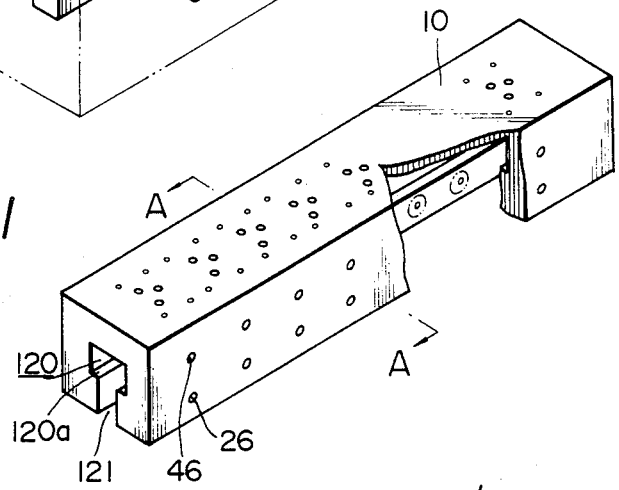
FIG. 31 is a partially broken perspective view of a beam block for holding a plurality of melt-spinning packs usable for the present invention.
Figure 32:
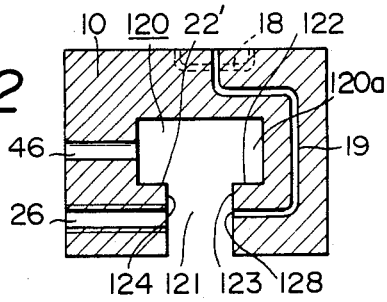
FIG. 32 is a lateral cross-sectional view of the beam block at A—A in FIG. 31.

Referring to FIGS. 31 and 32, the beam block 10 has a cavity 120 having a T-shaped cross sectional profile. The cavity 120 is composed of a horizontal upper portion 120*a* and a vertical lower portion 121. The width of the horizontal upper portion 120*a* is slightly larger than the width of the vertical lower portion 121. A longitudinal side surface of the vertical lower portion 121 of the cavity 120 has one or more polymer melt outlets 128. The other longitudinal side surface of the vertical lower portion 121 has a tapped hole 26 for a pushing member.

Figure 33:
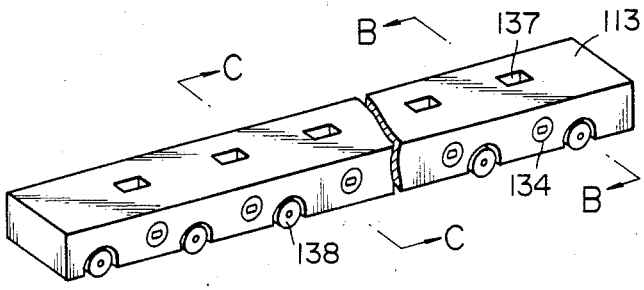
FIG. 33 is a partially broken perspective view of a rail to be inserted into the beam block.
Figure 34:
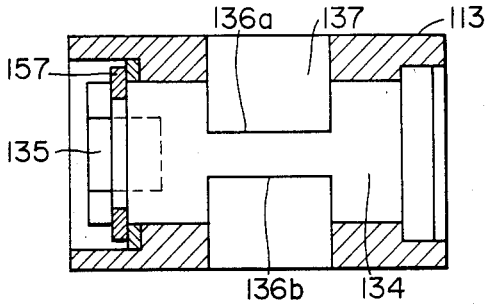
FIG. 34 is a lateral cross-sectional view of the rail at B—B in FIG. 33.
Figure 35:
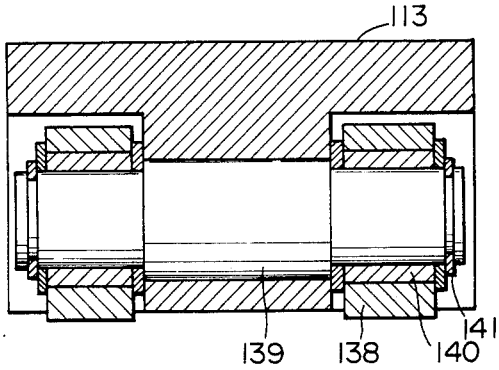
FIG. 35 is another lateral cross-sectional view of the rail at C—C in FIG. 33.

The horizontal upper portion 120*a* of the cavity 120 is used to receive a rail 113 as shown in FIGS. 33 to 35.

The rail 113 has a plurality of rollers 138, hanging pins 134 inserted thereinto, and holes 137 for holding the melt-spinning packs 16.

Referring to FIG. 34, the hanging pin 134 has a middle narrow portion having flat upper and lower surfaces 136*a* and 136*b*. The left end portion of the hanging pin 134 has a non-circular closed hole 135. The hanging pin 134 is rotatably fixed to the rail 113 by a snap ring 157. That is, when the hanging pin 134 is rotated, the direction of the flat surfaces 136*a* and 136*b* can be varied.

Referring to FIG. 35, a pair of rollers 138 are rotatably set to the lower surface portion of the rail 113 by means of shafts 140 and snap ring 141.

Figure 37:
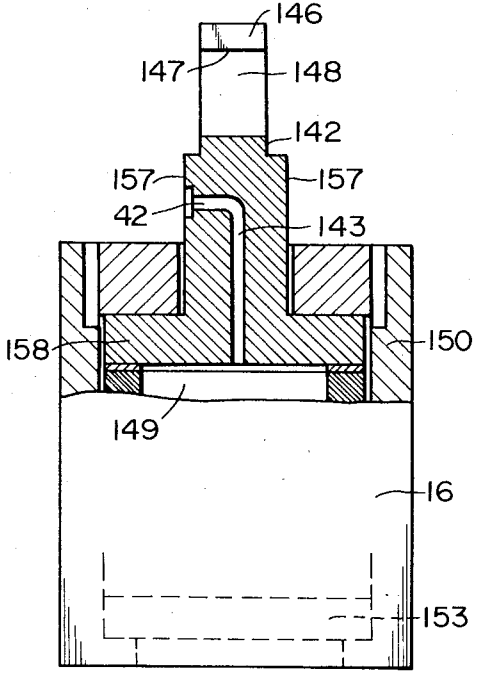
FIG. 37 is a cross-sectional view of the melt-spinning pack at D—D in FIG. 36.
Figure 36:
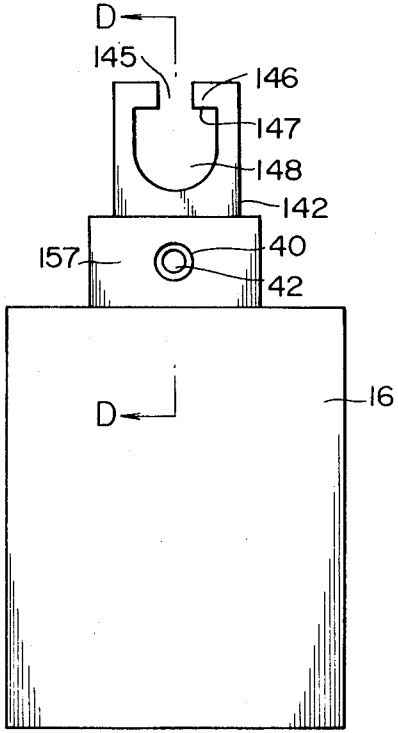
FIG. 36 is a back view of a melt-spinning pack usable for the apparatus as shown in FIG. 28.

Referring to FIGS. 36 and 37, the melt-spinning pack 16 has a head projection 142 extending upward. The top end portion of the head projection 142 has a pair of projections 146 and a narrow gap 145 formed between the projections 146, which gap 145 allows the narrow middle portion of the hanging pin 134 of the rail 113 to pass therethrough. The projections 146 have plain lower surface 147. The top portion of the head projection 142 has a vacant space 148 connected to the gap 145. When the fixing pin 134 is inserted to the top portion of the head projection 142 through the gap 145, the vacant space 148 allows the middle narrow portion of the fixing pin 134 to freely rotate therewithin.

Referring to FIGS. 36 and 37, the head projection 142 has a lower portion thereof having a pair of plain vertical surfaces 157. One of the plain vertical surface 157 has one or more polymer melt inlets 42 connected to polymer melt passages 143 formed in the passage block 158. The polymer melt supplied through the passage 143 is fed into a spinneret 153 through a filter 149.

Figure 39:
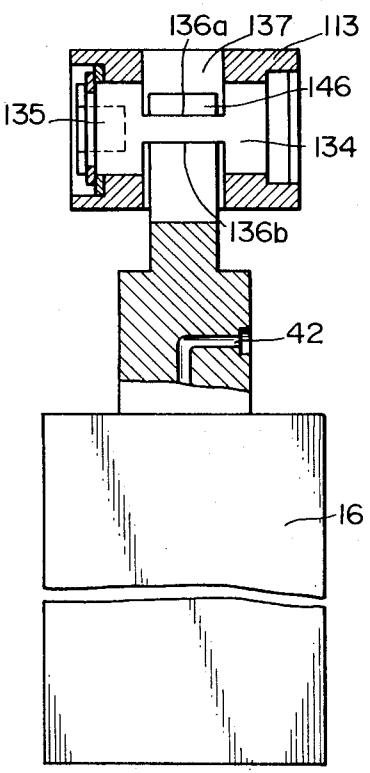
FIG. 39 is a cross-sectional view of the rail-melt-spinning pack combination at E—E in FIG. 38.
Figure 38:
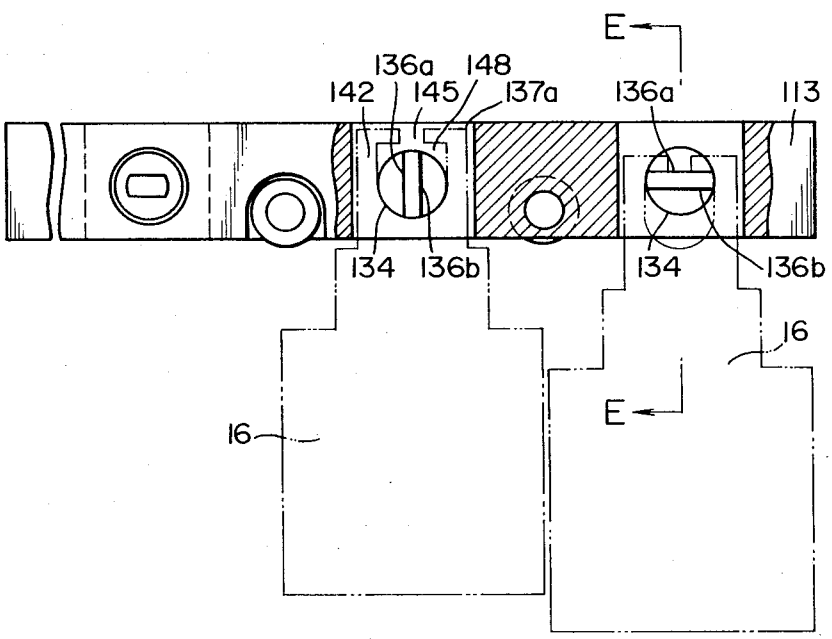
FIG. 38 is a partial cross-sectional view of a rail combined with melt-spinning packs.

Referring to FIGS. 38 and 39, before a melt-spinning pack 16 is set to the rail 113, the narrow middle portion 136*a*, 136*b* of the hanging pin 134 is made vertical as indicated in the middle portion of FIG. 38. Then, the top end portion of the head projection 142 is inserted into the rail 113 so that the vertical narrow middle portion of the fixing pin 134 passes through the gap 145 and comes into the vacant space 148. Next, the pin 134 is rotated so as to make the narrow middle portion of the pin 134 horizontal as shown in the right side portion of FIG. 38. The lower surfaces 147 of the projections 146 come into contact with the upper surface 136*a* of the horizontal narrow middle portion of the fixing pin 134, as shown in FIGS. 38 and 39. That is, the melt-spinning pack 16 is hung and held by the rail 113.

The melt-spinning pack 16 can be easily detached from the rail 113 by carrying out the above-mentioned operations in reverse.

Also, the melt-spinning pack 16 can be easily detached from the rail 113 fixed to the beam block 10.

The rail 113 is easily inserted together with one or more melt-spinning packs into the beam block 10 by means of rollers 138.

Referring to FIG. 29 and 32, the head projection 142 inserted into the cavity 120 is pushed toward the longitudinal side surface 123 having one or more polymer melt outlets 128, by means of a pushing bolt (not shown) inserted through a holes 44 and a tapped hole 26 so as to fluidtightly connect the polymer melt inlets 42 to the outlets 128. Also the rail 113 is fixed to the beam block 10 by means of a hanging pin or bolt (not shown) inserted through a hole 25 and a hole 46.

I claim:

1. A melt-spinning apparatus for producing synthetic fibers comprising:

(A) a heating box having a space surrounded by the heating box, said space being open to the atmosphere at the bottom of the heating box;

(B) a block surrounded by and supported by the heating box and the block having a cavity, the cavity having an opening into the space of the heating box at the bottom of the block;

(C) a melt-spinning pack having a head projection extending upward from a top of the melt-spinning pack and said melt spinning pack is inserted upward into the space of the heating box, the head projection being inserted upwardly into the opening of the cavity of the block and being detachably set to the block;

(D) a polymer melt outlet positioned in a first vertical wall defining a portion of the cavity of the block and the melt outlet is connected to a polymer melt-feeding source through a first conduit formed in the block;

(E) a polymer melt inlet positioned in a second vertical wall defining a portion of the head projection, the melt inlet in communication with a spinning orifice through a second conduit formed in the melt-spinning pack and faces the polymer melt outlet at the position at which the head projection of the melt-spinning pack is set to the block;

(F) a gasket positioned around the opening of the polymer melt inlet of the head projection of the melt-spinning pack;

(G) fixing means for detachably setting the head projection of the melt-spinning pack to the block, which comprises a shifting member inserted from the outside of the block opposite the polymer melt inlet toward the cavity of the block, the shifting member contacting the head projection, the insertion of the shifting member causing the head projection to move to a position at which the polymer melt inlet comes into contact with the polymer melt outlet through the gasket and to be set to the block;

(H) at least one first portion formed on at lest one vertical wall defining the cavity of the block;

(I) at least one second portion formed on at least one vertical wall defining the head projection of the melt-spinning pack the first and second portions being configured in a relationship to each other adequate to allow the gasket set up around the polymer melt inlet to be spaced from the first vertical wall of the block while the head projection is inserted upward into the cavity of the block up to a top position thereof and the head projection being movable from a top position toward a position at which the polymer melt inlet of the head projection is connected to the polymer melt outlet through the gasket.

2. The apparatus as claimed in claim 16, wherein the fixing means further comprises a hanging pin detachably inserted from the outside of the heating box through a longitudinal side wall of the block and the head projection of the melt-spinning pack into an other longitudinal side wall of the block.

3. The apparatus as claimed in claim 2, wherein the other longitudinal side wall of the head projection is provided with a concavity, and the shifting member is inserted into the concavity.

4. The apparatus as claimed in claim 2, wherein the shifting member is engaged with the other longitudinal side wall of the block in a screw-tapped hole engagement, to absorb a reaction force created against the shifting force applied to the shifting member by the other longitudinal side wall of the block.

5. The apparatus as claimed in claim 1, wherein the block has at least two polymer melt outlets and the head projection of the melt-spinning pack has corresponding polymer melt inlets thereto.

6. The apparatus as claimed in claim 1, wherein the heating box contains a plurality of melt-spinning packs and the block is capable of being divided into a plurality of constituents, each block constituent holding at least one melt-spinning pack.

7. The apparatus as claimed in claim 1, wherein the heating box has an entrance arranged in a lateral side wall thereof, a horizontal rail is inserted removably into the cavity of the beam block through the entrance, and the melt-spinning pack is set detachably on the horizontal rail.

8. The apparatus as claimed in claim 1, wherein the first portion defines vertical grooves formed in the lateral side wall normal to the first vertical wall, the vertical grooves are widened toward the first vertical wall having the polymer melt outlet and the second portion is composed of top projections extending from the top portions of lateral side walls normal to the second vertical wall, the top projections extends in directions normal to the lateral side walls, and the top projections are received in the vertical grooves.

9. The apparatus as claimed in claim 1, wherein the first portion defines a top concave section formed in the first vertical wall having the polymer melt outlet and the second portion is composed of a top projection extending from a top portion of the second vertical wall having the polymer melt inlet in a direction normal to the second vertical wall, which top projection on the second vertical wall is received in the top concave section of the first vertical wall.

10. The apparatus as claimed in claim 1, wherein the first portion is composed of a pair of bottom projections extending from the bottom portion of, the first vertical wall having the polymer melt outlet, said bottom projections being spaced from each other to form a guide groove therebetween, and the second portion defines bottom concave sections formed in the bottom portions of the second vertical wall having the polymer melt inlet, which bottom projections are received in the bottom concave sections

11. The apparatus as claimed in claim 1, wherein first portions are formed on each of two vertical walls normal to the first vertical wall of the block, a vertical groove being formed by each of the first portions, and the second portion is a projection extending from each of two vertical walls normal to the second vertical wall of the head projection in a direction normal to each vertical wall, each projection being received in each vertical groove.

* * * * *